US006325696B1

(12) United States Patent
Boggs et al.

(10) Patent No.: US 6,325,696 B1
(45) Date of Patent: Dec. 4, 2001

(54) PIEZO-ACTUATED CMP CARRIER

(75) Inventors: Karl E. Boggs, Hopewell Junction; Kenneth M. Davis, Newburgh; William F. Landers, Wappingers Falls; Michael F. Lofaro, Marlboro; Adam D. Ticknor, Wappingers Falls; Ronald D. Fiege, Hopewell Junction, all of NY (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/395,393

(22) Filed: Sep. 13, 1999

(51) Int. Cl.[7] ..... B24B 49/00

(52) U.S. Cl. ..... 451/5; 451/6; 451/11; 451/41; 451/288; 451/380

(58) Field of Search ..... 451/5, 6, 9, 10, 451/11, 41, 42, 285, 290, 228, 380

(56) References Cited

U.S. PATENT DOCUMENTS

| | | | | |
|---|---|---|---|---|
| 4,272,924 | | 6/1981 | Masuko et al. . | |
| 4,450,652 | | 5/1984 | Walsh . | |
| 4,602,459 | * | 7/1986 | Drits et al. | 451/8 |
| 5,036,015 | | 7/1991 | Sandhu et al. . | |
| 5,036,630 | | 8/1991 | Kaanta et al. . | |
| 5,076,026 | | 12/1991 | Mizuguchi et al. . | |
| 5,117,589 | * | 6/1992 | Bischoff et al. | 451/285 |
| 5,196,353 | | 3/1993 | Sandhu et al. . | |
| 5,486,129 | | 1/1996 | Sandhu et al. . | |
| 5,577,948 | | 11/1996 | Kordonsky et al. . | |
| 5,605,487 | | 2/1997 | Hileman et al. . | |
| 5,618,447 | | 4/1997 | Sandhu . | |
| 5,651,724 | | 7/1997 | Kimura et al. . | |
| 5,653,622 | | 8/1997 | Drill et al. . | |
| 5,685,766 | | 11/1997 | Mattingly et al. . | |
| 5,720,845 | | 2/1998 | Liu . | |
| 5,722,156 | * | 3/1998 | Balfrey et al. | 451/41 |
| 5,723,775 | * | 3/1998 | Watanabe et al. | 73/105 |
| 5,800,248 | | 9/1998 | Pant et al. . | |
| 5,816,895 | | 10/1998 | Honda . | |
| 5,846,398 | | 12/1998 | Carpio . | |
| 5,868,896 | * | 2/1999 | Robinson et al. | 451/289 |
| 5,997,384 | * | 12/1999 | Blalock | 451/41 |
| 6,045,431 | * | 4/2000 | Cheprasov et al. | 451/5 |
| 6,102,777 | * | 8/2000 | Duescher et al. | 451/36 |

OTHER PUBLICATIONS

Lynch, "Piezoelectric damper hones ski performance", *Design News*, Feb. 5, 1996, p. 53.

Brochure, Active Control eXperts, Inc., © 1994.

* cited by examiner

*Primary Examiner*—M. Rachuba

(74) *Attorney, Agent, or Firm*—Wood, Phillips, VanSaten, Clark & Mortimer

(57) ABSTRACT

A chemical-mechanical polishing (CMP) control system controls distribution of pressure across the backside of a semiconductor wafer being polished. The system includes a CMP apparatus having a carrier for supporting a semiconductor wafer. The carrier includes a plurality of dual function piezoelectric actuators. The actuators sense pressure variations across the semiconductor wafer and are individually controllable. A control is connected to the actuators for monitoring sensed pressure variations and controlling the actuators to provide a controlled pressure distribution across the semiconductor wafer.

14 Claims, 5 Drawing Sheets

PIEZO-ACTUATED CMP CARRIER

FIELD OF THE INVENTION

This invention relates to chemical-mechanical polishing of semiconductor wafers and, more particularly, to an apparatus and method for controlled actuation of a wafer backing film.

BACKGROUND OF THE INVENTION

Chemical-mechanical polishing (CMP) is performed in the processing of semiconductor wafers and/or chips on commercially available polishers. The CMP polisher can have a circular rotating polish pad and rotating carrier for holding the wafer or, as with the newest tools entering the market, may be designed with an orbital or linear motion of the pad and carrier. In general practice, a slurry is supplied to the polish pad to initiate the polishing action. However, here again, newest tooling may make use of what is referred to as Fixed Abrasive pads, whereby the abrasive is embedded within the polish pad and is activated by DI water or some other chemical as may be desired for the specific polish process.

Ideally, a CMP polisher delivers a globally uniform, as well as locally planarized wafer. However, global uniformity on a wafer-to-wafer basis is difficult to achieve. Hard pads are used on a polishing table or platen for their ability to provide optimum planarity. However, these pads require a softer pad under layer to generate an acceptable level of uniformity. The application of wafer backside air is also a standard practice in an attempt to provide a localized area of force to the backside of the wafer in those radii where the polish may be lower due to wafer bow, collapse of the backing film, degradation or collapse of the polish pads, or poor slurry distribution.

Recently, a phenomenon known as "edge bead" has detracted from acceptable yields. The edge bead is a ring of thicker oxide at a radius of 96 mm with a 100 mm wafer. A secondary thickness variation at 80–90 mm has also been observed. The location of these thickness variations may also shift across the wafer unexpectedly for reasons not fully understood. This results in nonusable chips at the wafer perimeter or a variation in chip performance regionally across the wafer. Also, the wafer film to be polished may have a varying consistency from doping, thickness or the like, across the surface of the wafer. This creates varying, uncontrollable polish rates across the wafer. Neither of the problems described above can be compensated for with the tooling currently available.

Various mechanical methods have been attempted to alter the final thickness profile of a polished wafer. One method uses fixed curvatures or shapings of the carrier face. These are directed to control only a centered edge thickness variation by bowing the carrier face at the center to supply a greater force at the wafer center. This provides an increased rate of polish center to edge.

Another known method applies shims to the carrier face behind the wafer backing film. This enables a wider range of diameters and widths to be rotated on and off a flat carrier as needed. However, the milling of a carrier face to a shape requires a number of carriers to provide a range of results. This requires substantial time to change from one shaped carrier to another as the need arises.

The present invention is directed to overcoming one or more of the problems discussed above, in a novel and simple manner.

SUMMARY OF THE INVENTION

In accordance with the invention there is provided an active control mechanism by which concentric, non-uniformity on a wafer-to-wafer basis is tailored to meet desired results.

It is one object of the invention to provide a means by which regional, non-concentric non-uniformity can be overcome.

It is another object of the invention to provide the capability to use non-uniform controls to within die levels, thereby overcoming film polish rate variations due to chip design.

In one aspect of the invention there is disclosed a chemical-mechanical polishing (CMP) apparatus for polishing a semiconductor wafer, in which the CMP apparatus has a carrier for the wafer. The carrier includes a carrier base and a wafer retaining ring mounted to the base for retaining the wafer for polishing. A plurality of dual function piezoelectric actuators are mounted to the base within a perimeter of the retaining ring. The actuators sense pressure variations across the wafer and are individually controllable to provide a controlled pressure distribution across the wafer.

It is a feature of the invention that the actuators comprise thin film dual function piezoelectric actuators.

It is another feature of the invention to provide a backing film mounted to the base between the actuators and the wafer.

It is a further feature of the invention that the actuators are embedded in the backing film.

In accordance with another aspect of the invention there is disclosed a CMP control system for controlling distribution of pressure across the backside of a semiconductor wafer being polished. The system includes a CMP apparatus having a carrier for supporting the wafer. The carrier includes a plurality of dual function piezoelectric actuators. The actuators sense pressure variations across the wafer and are individually controllable. A control is connected to the actuators for monitoring sensed pressure variations and controlling the actuators to provide a controlled pressure distribution across the wafer.

It is a feature of the invention that the control comprises a programmed control that controls pressure distribution according to a die layout of the wafer.

It is another feature of the invention that the control includes a notch location program for determining orientation of the wafer in the carrier and the control varies the pressure distribution responsive to the die layout and determined orientation.

In accordance with a further aspect of the invention there is disclosed a method of polishing a semiconductor wafer in a CMP system. The method comprises the steps of providing a CMP apparatus having a carrier for supporting the wafer, the carrier including a plurality of dual function piezoelectric actuators, the actuators sensing pressure variations across the semiconductor wafer and being individually controllable; monitoring sensed pressure variations; and controlling the actuators to provide a controlled pressure distribution across the semiconductor wafer.

In accordance with an additional aspect of the invention, there is disclosed a computer-readable storage medium having stored therein instructions for performing a method of polishing a semiconductor wafer in a chemical-mechanical polishing (CMP) system. The CMP system has a carrier for supporting the wafer, and the carrier includes a plurality of dual function piezoelectric actuators; the actuators sense pressure variations across the wafer and are individually controllable. The method comprises the steps of monitoring sensed pressure variations, and controlling the actuators to provide a controlled pressure distribution across the wafer. The actuators may comprise thin film dual function piezoelectric actuators. Furthermore, the computer-readable storage medium may have stored therein information regarding a die layout of the wafer; the controlling step may further comprise the step of controlling the actuators to provide a controlled pressure distribution according to the die layout of the wafer. In addition, the wafer may have a notch for determining orientation of the wafer, and the medium may have stored therein an algorithm for determining the orientation of the wafer in accordance with location of the notch; the controlling step may further comprise the steps of implementing a program using the algorithm to determine the orientation of the wafer in the carrier, and controlling the actuators to vary the pressure distribution responsive to the die layout and the determined orientation.

Further features and advantages of the invention will be readily apparent from the specification and from the drawings.

DETAILED DESCRIPTION OF A PREFERRED EMBODIMENT OF THE INVENTION

Figure 1:
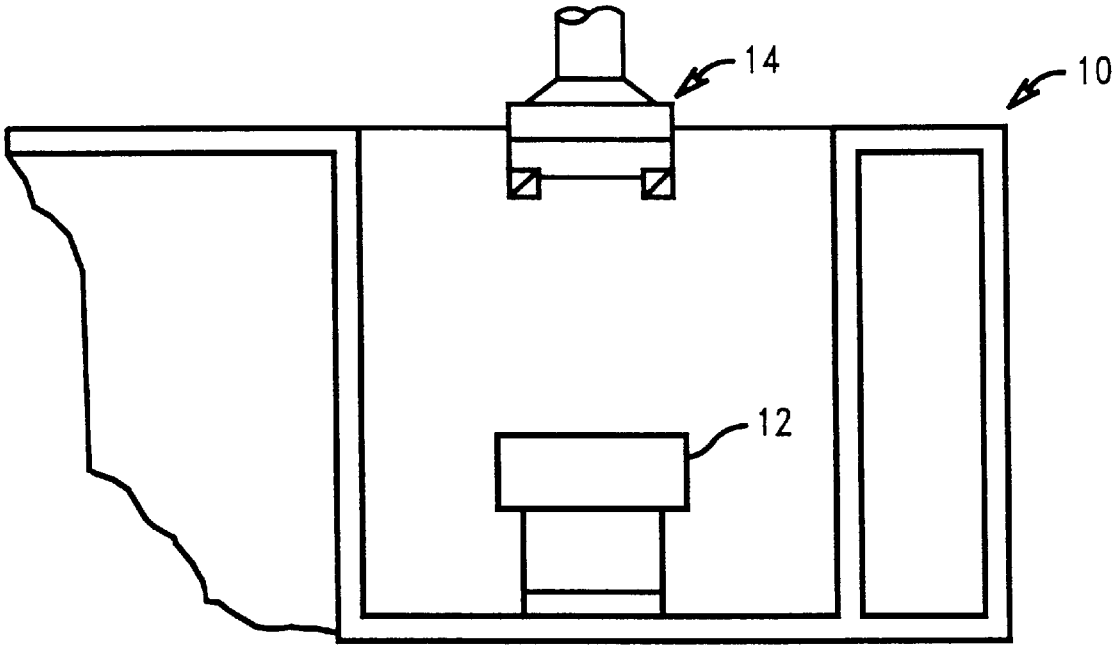
FIG. 1 is a side, partial sectional view of a chemical-mechanical polishing apparatus adapted for controlled actuation of a wafer backing film in accordance with the invention.

Referring initially to FIG. 1, a chemical-mechanical polishing (CMP) apparatus 10 is illustrated. The CMP apparatus 10 is generally of conventional overall construction and includes a circular polishing table 12 and rotating carrier 14, although, as previously noted, may include a wide range of design and innovative technology. In accordance with the invention, the carrier 14 is adapted for controlled actuation of a wafer backing film, as described below. The CMP apparatus 10 is used during integrated circuit manufacturing for polishing semiconductor wafers and chips which include integrated circuits.

Figure 2:
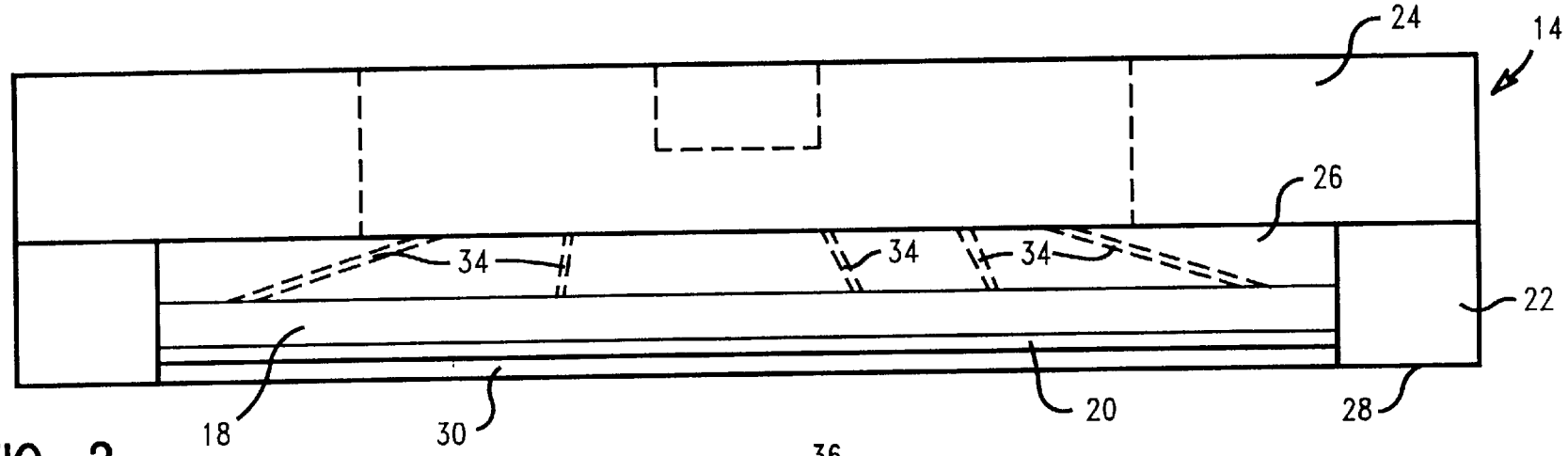
FIG. 2 is a side elevation view, partially in section, for a carrier of the apparatus of FIG. 1.
Figure 3:
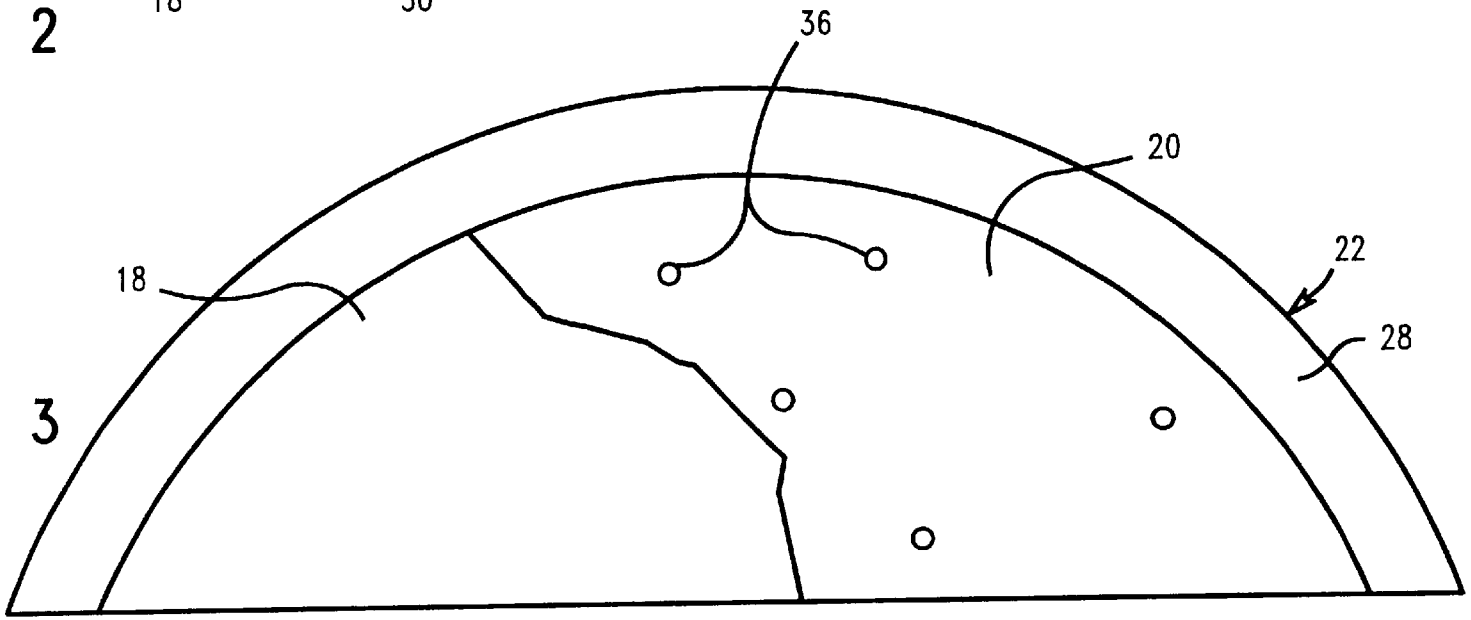
FIG. 3 is a partial bottom plan view of the carrier of FIG. 2 with a portion of a backing film cut away.
Figure 4:
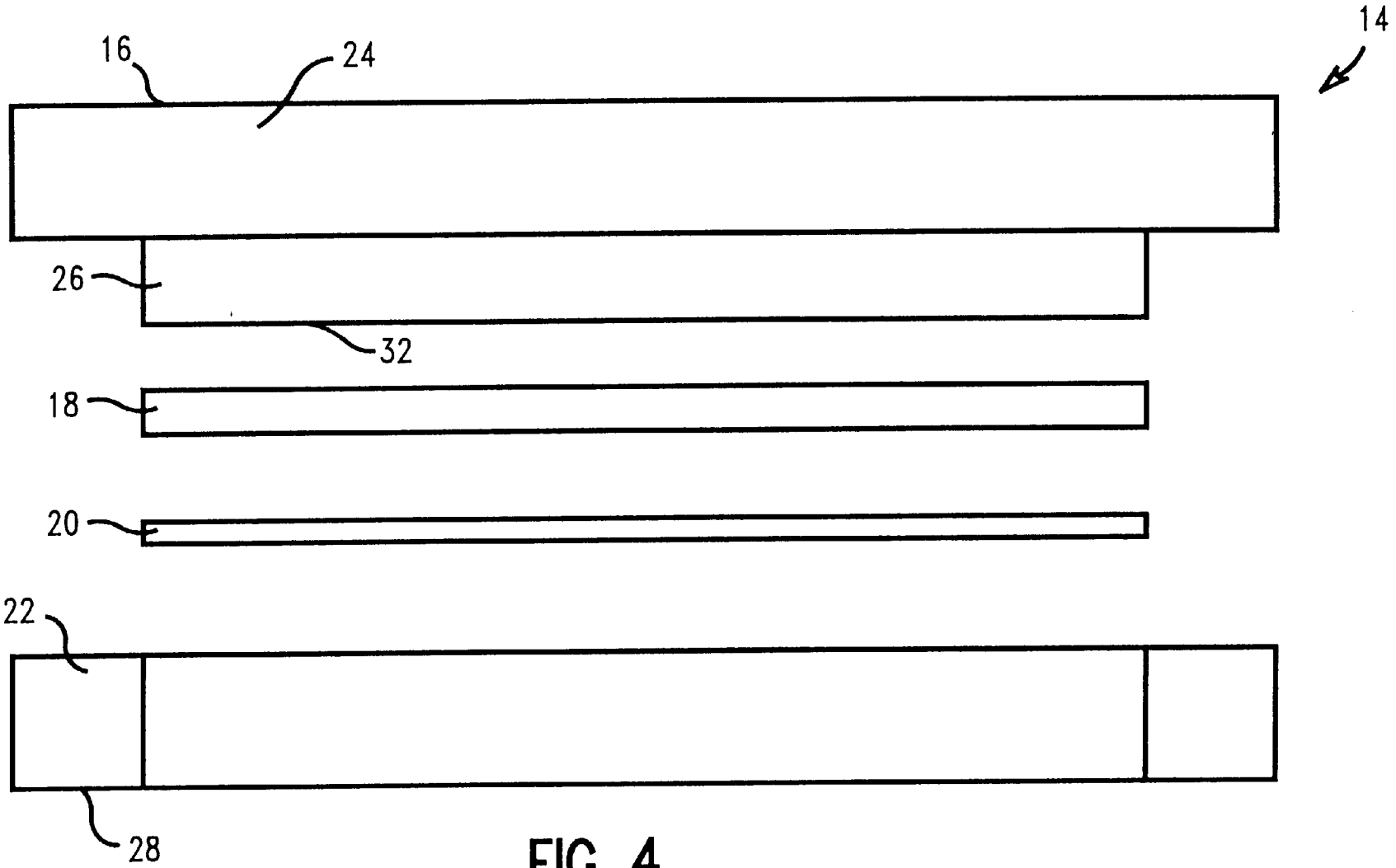
FIG. 4 is an exploded view of the carrier of FIG. 2.

Referring to FIGS. 2–4, the carrier 14 is illustrated in greater detail. The carrier 14 includes a carrier base 16, a piezoelectric insert layer 18, a backing film 20, and a wafer retaining ring 22.

The base 16 includes a first circular body 24 and a second, concentric circular body 26 having a smaller diameter than the first circular body 24. The second circular body 26 is mounted to the underside of the first circular body 24. The retaining ring 22 has an inner diameter corresponding to the outer diameter of the second concentric body, and an outer diameter substantially equivalent to the outer diameter of the first circular body 24. The axial length of the retaining ring 22 is greater than the axial length of the second circular body 26. The retaining ring is mounted to the base 16 surrounding the second circular body 26, as shown in FIG. 2, with its lower face 28 extending below a lower surface 32 of the second circular body 26 to define a circular cavity 30. The piezoelectric insert layer 18 and the backing film 20 are disposed within the circular cavity 30, as shown in FIG. 2. Particularly, the insert layer 18 is mounted to the second circular body underside surface 32 with the backing film 20 then being positioned below the insert layer 18. As can be seen in FIG. 2, a portion of the circular cavity 30 remains below the backing film 20 for supporting a semiconductor wafer, as described below.

As is conventional, a plurality of passages 34 are provided through the second circular body 26 for connection to a vacuum. The backing film 20 includes a plurality of apertures 36, see FIG. 3. The passages 34 are connected to a vacuum source, in use, for holding a semiconductor wafer within the carrier cavity 30. It should be noted there are alternative carrier designs that do not make use of backside air and/or vacuum. The invention described herein is applicable to these carrier designs as well.

Figure 5:
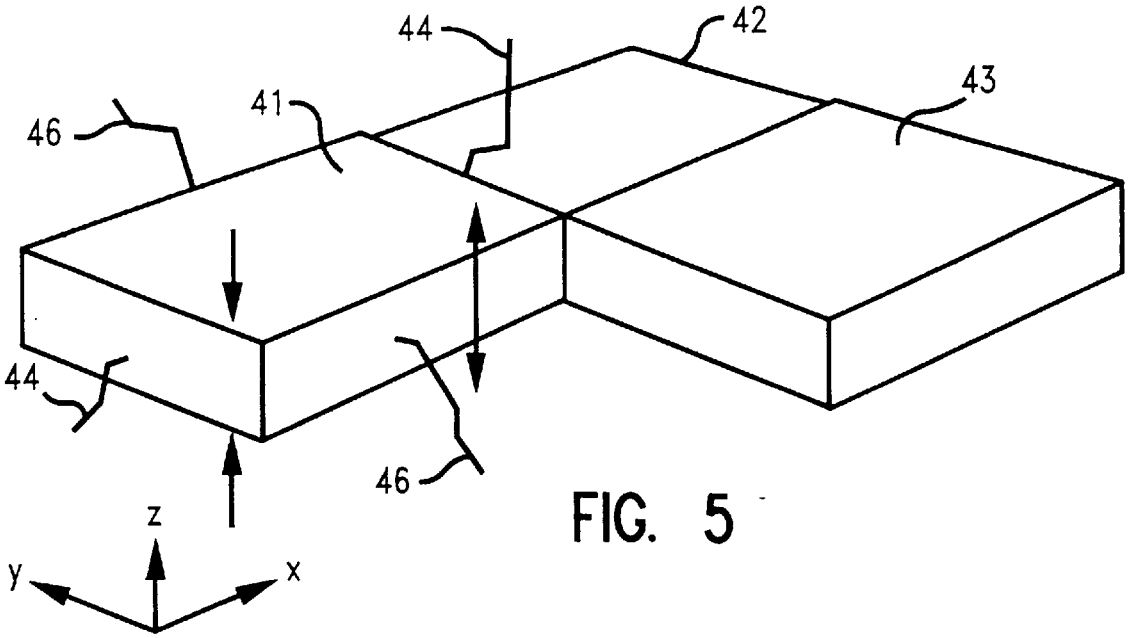
FIG. 5 is a partial perspective view illustrating actuators of the carrier of FIG. 2.

The piezoelectric insert layer 18 utilizes a plurality of thin film, dual-function piezoelectric actuators. Referring to FIG. 5, three piezoelectric actuators 41, 42 and 43 are illustrated. As shown, the first piezoelectric actuator 41 includes a first set of conductors 44 in an x direction and a second set of conductors 46 in a y direction. A force exerted up on the piezo element 41 in the z direction create s a voltage about the oppose plane in the x direction across the conductors 44. Conversely, a supplied voltage in the y direction across the second set of conductors 46 caused an expansion of the piezoelectric element 41 in the z direction. Thus, the piezoelectric actuator 41 provides real-time feedback for an immediate controlled response within a single package. Its small size and sensitivity range is utilized for the task of monitoring and responding to varying pressures across a wafer during a polishing process.

Although not shown, the actuators 42 and 43 include separate conductors and operate similarly to the actuator 41.

As is apparent, the specific size, shape and operating range of the carrier 14 in its entirety is determined from the wafer size, shape and thickness. The specific size and shape of each actuator 41–43 is determined from the smallest die size and chip dimensions, i.e., pattern densities, to be polished. While FIG. 5 illustrates three actuators 41–43, as is apparent, the insert layer 18 might include hundreds of actuators.

While the insert layer 18 is illustrated independently and underneath the backing film 20, the backing film 20 could be eliminated. Alternatively, the insert layer 18 could be embedded in the backing layer 20. The embedded piezoelectric actuators compensate for any variability inherent in the material composition of the backing film 20.

Figure 6:
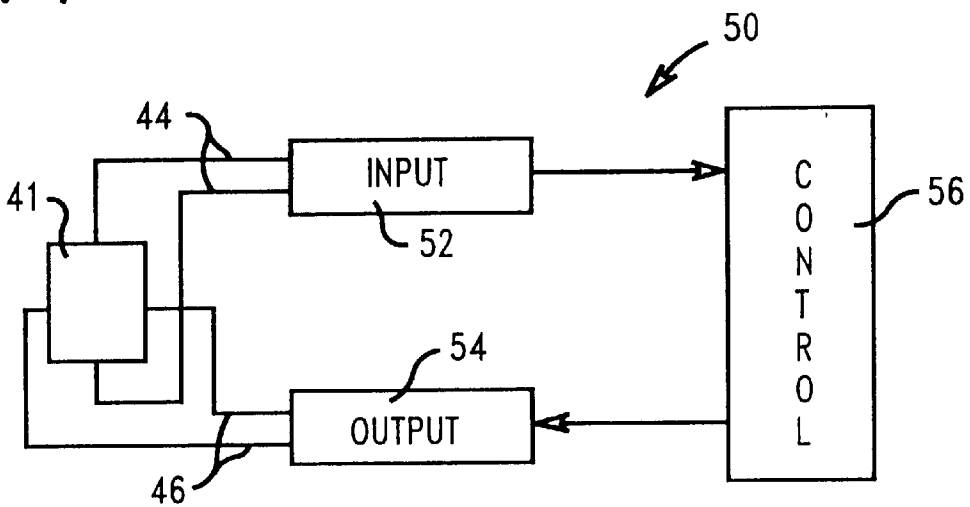
FIG. 6 is a block diagram illustrating a control system for the CMP apparatus of FIG. 1.

Referring to FIG. 6, a control system 50 in accordance with the invention is illustrated. The control system 50 is shown connected to the piezoelectric actuator 41. The control system 50 includes an input interface circuit 52, an output interface circuit 54, and a control 56. The input interface circuit is connected across the conductors 44, while the output interface circuit 54 is connected across the second conductors 46. While not shown, all of the actuators used with a particular carrier 12 would be connected to the input and output circuits 52 and 54, respectively.

Figure 7:
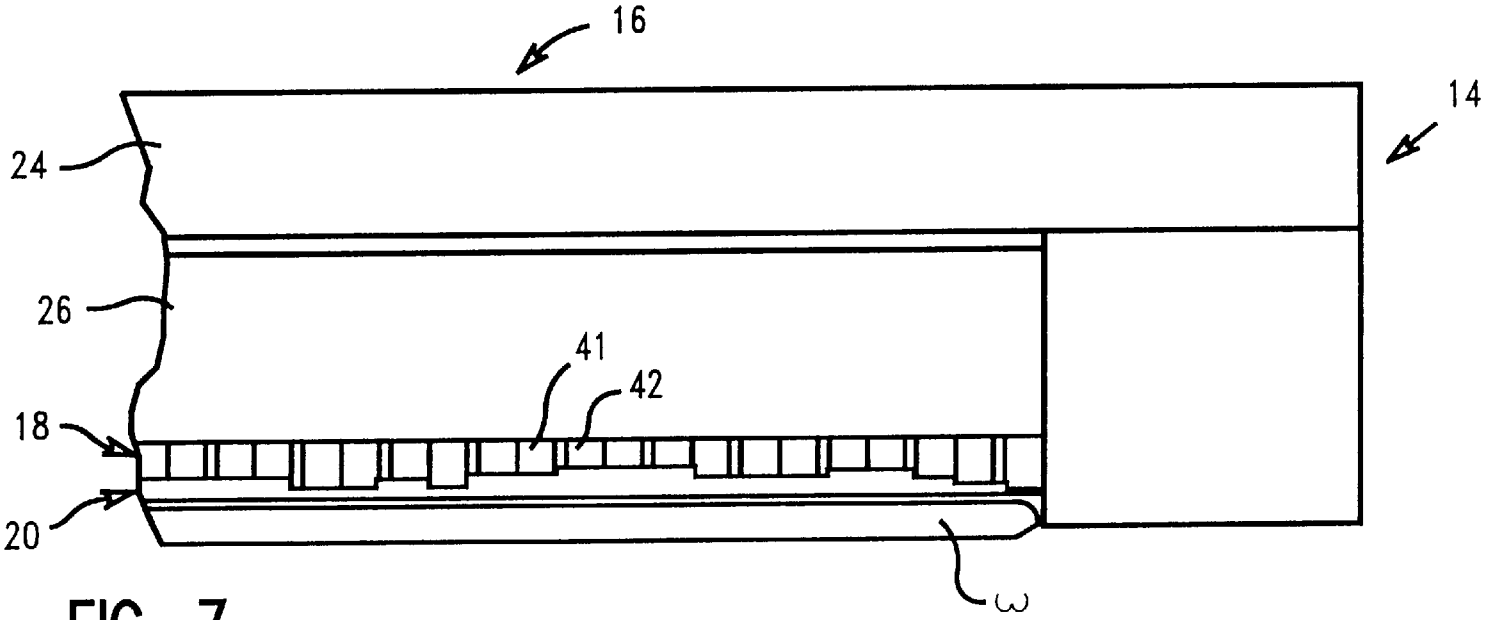
FIG. 7 is a view similar to that of FIG. 2 showing regional pressure variations induced by piezoelectric actuators in accordance with the invention.

The control 56 comprises a software controlled device, such as a microprocessor, microcontroller, personal computer or the like. The control 56 includes a suitable storage medium, and operates in accordance with stored programs for controlling operation of the actuators, such as the actuator 41. The control operation may be fully-automated, semi-automated or manual, as necessary or desired. In use as a fully-automated system, the control 56 reads pressure variations across a wafer, as sensed by all of the actuators, and compensates for pressure variations in situ by activating one or more of the piezoelectric actuators until a uniform pressure distribution across the wafer is reached. This is particularly illustrated in FIG. 7, where a wafer w is mounted in the carrier 14. The piezoelectric insert layer 18 illustrates the regional pressure variations induced by individual piezoelectric actuators, such as the actuators 41 and 42.

Figure 8:
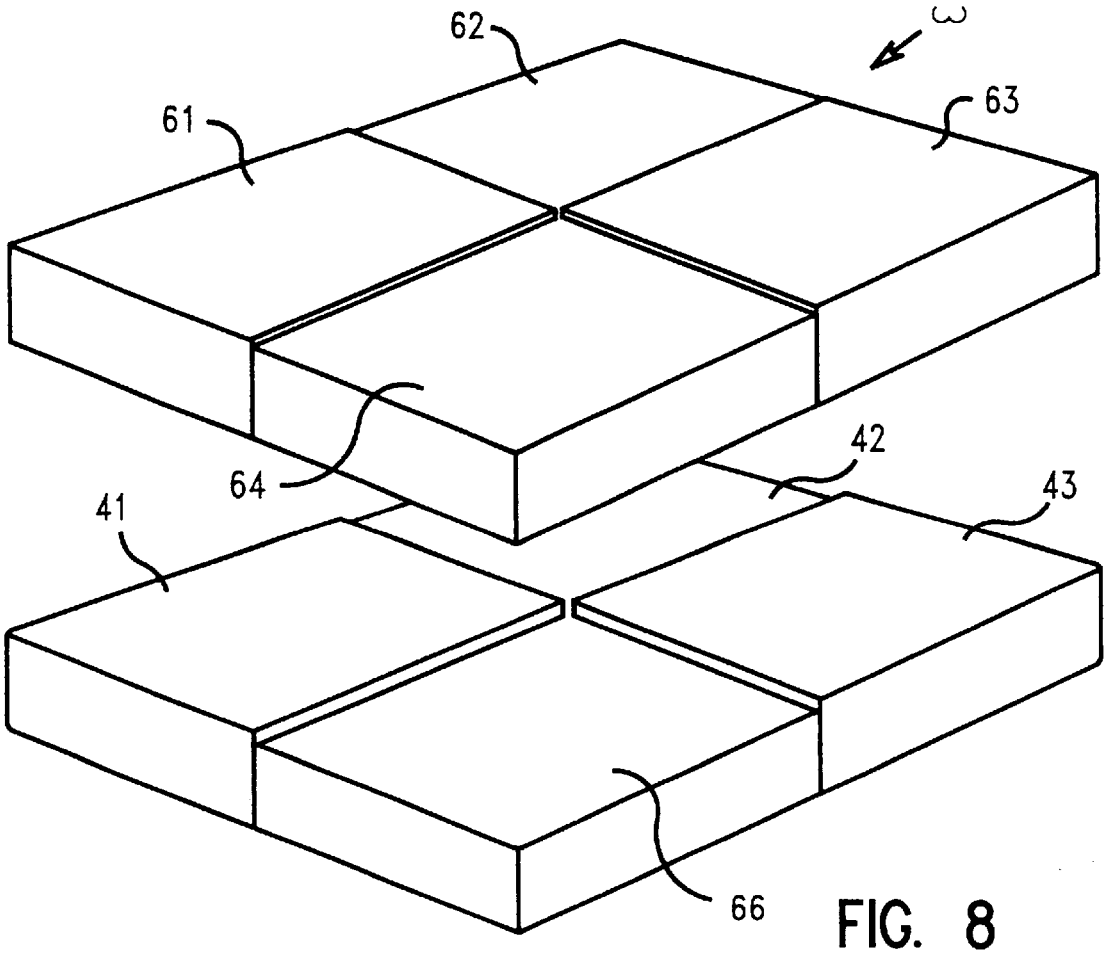
FIG. 8 is a partial perspective view illustrating localized pressure variations within wafer die areas in accordance with the invention.

FIG. 8 illustrates a section of the wafer w subdivided to illustrate single chips 61, 62, 63 and 64. The chips 61 and 63 have low pattern density, which causes associated actuators 41 and 43 to be actuated. The dies 62 and 64 have higher pattern densities, causing associated actuators 42 and 66 to be inactive. Thus, in accordance with the invention, the control system 50 provides uniform pressure distribution across the wafer w.

In the semi-automated mode, the control function described above is enhanced by allowing an operator to supersede actuation of any element within the matrix of the insert layer 18. This can be used to control a known rate variation across the wafer w that is not a function of pressure. Such a variable could include, but is not limited to, non-uniform doping of the film to be polished or a non-uniform incoming film thickness. Neither of these conditions would be sensed by an actuator, yet both have considerable influence over polish rate.

The wafer w is loaded into the carrier 14 by any conventional means. Typically, the wafer is provided with a notch indicating a reference location. The control 56 initiates a notch location algorithm which actuates, in series, each piezoelectric actuator located at the outermost perimeter of the layer 20 and reads the responding pressure. When the element located under the notch is activated, the responding pressure is less than all other elements. This allows the wafer w to be held in a known orientation at all times once the notch is located and using the vacuum pressure, described above.

The control 56 includes a suitable memory that may hold various wafer maps with die layouts, size and pattern density within a memory device. Once the notch is located, using the notch location algorithm, an appropriate wafer map can be downloaded to the appropriate piezoelectric actuators according to the known reference location. This, in effect, replicates die pattern density variations by activating those elements located under areas of low pattern density, as discussed relative to FIG. 8, to increase localized pressure and polish rates to those areas. This provides a pre-setting for those product types. The control system 50 then reads and responds to whatever regional or global pressure variations may exist, maintaining the pre-setting for improved localized planarity.

Thus, in accordance with the invention, there is provided an active control mechanism which uses thin film dual-function piezoelectric actuators to provide dynamic redistribution of force across the backside of a wafer during a polish cycle.

While the invention has been described in terms of a specific embodiment, it is evident in view of the foregoing description that numerous alternatives, modifications and variations will be apparent to those skilled in the art. Accordingly, the invention is intended to encompass all such alternatives, modifications and variations which fall within the scope and spirit of the invention and the following claims.

We claim:

1. A chemical-mechanical polishing apparatus for polishing a semiconductor wafer and having a carrier for the wafer, the apparatus comprising:

a carrier base;

a backing film mounted to the base;

a wafer retaining ring mounted to the base for retaining the wafer; and a plurality of dual function piezo electric actuators embedded in the backing film and mounted to the base within a perimeter of the retaining ring, the actuator sensing pressure variations across the wafer and being individually controllable to provide controlled pressure distribution across the wafer.

2. The apparatus of claim 1 wherein the actuators comprise thin film dual function piezoelectric actuators.

3. A chemical-mechanical polishing (CMP) control system for controlling distribution of pressure across a backside of a semiconductor wafer being polished, comprising:

a CMP apparatus having a carrier for supporting the wafer, a backing film mounted to the carrier, the carrier including a plurality of dual function piezo electric actuators, embedded in the backing film, the actuator sensing pressure variations across the wafer and being individually controllable; and a control connected to the actuators for monitoring sensitive pressure variations and controlling the actuators to provide a controlled pressure distribution across the wafer.

4. The CMP control system of claim 3 wherein the actuators comprise thin film dual function piezoelectric actuators.

5. The CMP control system of claim 3 wherein the control comprises a programmed control that controls pressure distribution according to a die layout of the wafer.

6. The CMP control system of claim 5 wherein the control includes a notch location program for determining orientation of the wafer in the carrier and the control varies the pressure distribution responsive to the die layout and determined orientation.

7. A method of polishing a semiconductor wafer in a chemical-mechanical polishing (CMP) system, comprising the steps of:

providing a CMP apparatus having a carrier for supporting the wafer, a backing film being mounted to the carrier, the carrier including a plurality of dual function piezoelectric actuators embedded in the backing film, the actuators sensing pressure variations across the wafer and being individually controllable;

monitoring sensitive pressure variations; and controlling the actuators to provide a controlled pressure distribution across the wafer.

8. The method of claim 7 wherein the providing step includes providing actuators comprising thin film dual function piezoelectric actuators.

9. The method of claim 7 wherein the controlling step further comprises the step of operating a programmed control that controls pressure distribution according to a die layout of the wafer.

10. The method of claim 9 wherein the controlling step implements a notch location program for determining orientation of the wafer in the carrier and the control varies the pressure distribution responsive to the die layout and determined orientation.

11. A method of polishing a semiconductor wafer in a chemical-mechanical polishing (CMP) system, comprising:

providing a CMP system having a carrier for supporting the wafer, a backing film mounted to the carrier, the carrier including a plurality of dual function piezoelectric actuators embedded in the backing film, the actuators sensing pressure variations across the wafer and being individually controllable;

providing a computer-readable storage medium having stored therein instructions for polishing a semiconductor wafer, the instructions including monitoring sensed pressure variations, and controlling the actuators to provide a controlled pressure distribution across the wafer; and controlling the actuators in accordance with the stored instructions.

12. The method of claim 11 wherein the first providing step comprises providing thin film dual function piezoelectric actuators.

13. The method of claim 11 wherein the medium has stored therein information regarding a die layout of the wafer, and the controlling step further comprises controlling the actuators to provide a controlled pressure distribution according to the die layout of the wafer.

14. The method of claim 13, wherein the wafer has a notch for determining orientation of the wafer, the medium has stored therein an algorithm for determining the orientation of the wafer in accordance with location of the notch, and the controlling step further comprises implementing a program using the algorithm to determine the orientation of the wafer in the carrier, and controlling the actuators to vary the pressure distribution responsive to the die layout and the determined orientation.

* * * * *